US006060155A

United States Patent [19]

Greve

[11] Patent Number: 6,060,155

[45] Date of Patent: May 9, 2000

[54] POLYMERIC FORMING TOOL

[75] Inventor: Bruce Norman Greve, Clarkston, Mich.

[73] Assignee: The Budd Company, Troy, Minn.

[21] Appl. No.: 09/020,000

[22] Filed: Feb. 6, 1998

[51] Int. Cl.[7] ..... B32B 5/16; F16C 29/02

[52] U.S. Cl. ..... 428/323; 428/325; 428/328; 384/30

[58] Field of Search ..... 428/323, 325, 428/328; 384/30

[56] References Cited

U.S. PATENT DOCUMENTS

| | | | |
|---|---|---|---|
| 3,918,218 | 11/1975 | Zoiss . | |
| 4,243,575 | 1/1981 | Myers et al. . | |
| 4,761,440 | 8/1988 | Laroche . | |
| 4,882,367 | 11/1989 | Laroche . | |
| 5,017,629 | 5/1991 | Wilson et al. | 523/219 |
| 5,049,342 | 9/1991 | Scanlon et al. | 264/250 |
| 5,124,178 | 6/1992 | Haenggi et al. | 427/204 |
| 5,516,478 | 5/1996 | Boszor | 264/258 |
| 5,633,085 | 5/1997 | Schleifstein . | |

*Primary Examiner*—Hoa T. Le
*Attorney, Agent, or Firm*—Harness, Dickey & Pierce, P.L.C.

[57] ABSTRACT

The present invention provides a material forming tool, such as a sheet metal stamping die, having a polymer matrix and filler material mixed therein. The filler material is a plurality of microspheres which are coated with a release agent. The coating of the release agent should be sufficient to allow the microspheres to rotate in the polymer matrix when the tool is used to form material.

18 Claims, 1 Drawing Sheet

POLYMERIC FORMING TOOL

BACKGROUND OF THE INVENTION

I. Technical Field

The present invention relates generally to a polymeric forming tool and, more particularly, to a polymeric forming tool with a plurality of coated microspheres mixed therein.

II. Discussion

In the field of manufacturing and material forming, there is an ever increasing focus on reducing manufacturing cost by increasing tooling durability. Increased tool durability results in decreased machine down time due to tooling changes. This decreased down time means increased machine cycle time and productivity for the manufacturing plant. Also, increased tool durability results in decreased tooling cost due to tooling repair or replacement.

Conventional material forming technology has attempted to address this issue in several ways. In the field of sheet metal stamping, stamping dies have been manufactured from cast zinc. The use of cast zinc has resulted in increased tooling life. However, the raw material cost of zinc and the machining cost of manufacturing stamping dies from zinc has increased the tooling cost to the manufacturer. Cast polymeric tooling has also been used in an attempt to lower the overall tooling cost. Although the cost of polymeric raw material has a lower tooling cost than zinc tooling, the low wear resistance of this material lowers the number of stampings which can be made during the life of the tool which results in increased machine down time. This increases manufacturing cost. The present invention was developed to overcome these drawbacks.

SUMMARY OF THE INVENTION

The present invention overcomes these problems by providing a material forming tool having a polymer matrix and filler material mixed therein. The filler material is a plurality of microspheres which are coated with a release agent. The coating of the release agent should be sufficient to allow the microspheres to rotate in the polymer matrix when the tool is used to form material.

In a second aspect of the present invention, a tool for forming a metal sheet in a press is provided which has a body with a contoured outer surface formed to a desired shape of a formed metal sheet. The body has a polymeric matrix and a plurality of glass microspheres distributed therein. The microspheres are coated with a release agent such that the microspheres at an outer surface of the body rotate in the polymeric matrix when the metal sheet is being formed by the body.

Additional advantages and features of the present invention will become apparent from the subsequent description and appended claims taken in conjunction with the accompanying drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENTS

Figure 1:
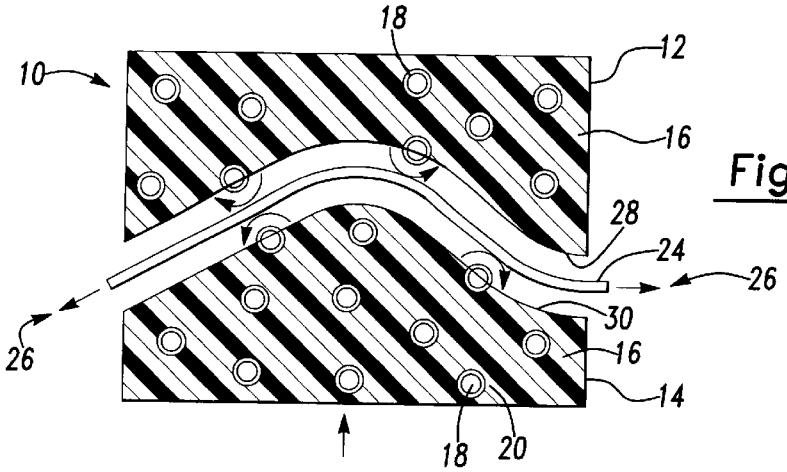
FIG. 1 is a cross-sectional view of a first embodiment of a tool for forming material according to the present invention.

With reference to FIG. 1, a first embodiment of the present invention is described. In FIG. 1, a pair of stamping dies generally designated as 10 has upper portion 12 and lower portion 14. Upper portion 12 has a polymeric matrix 16 with a plurality of microspheres 18 contained therein. Likewise, lower portion 14 is comprised of a polymeric matrix 16 with a plurality of microspheres 18 contained therein.

In general, upper portion 12 and lower portion 14 are moved toward each other to clamp material 24. As a result of this action, material 24 is deformed. This operation of the present invention will be discussed in greater detail.

Each microsphere 18 is coated with a release agent 20. The release agent 20 should be made of a compound which promotes low adhesion between the release agent 20 and the polymeric matrix 16 while promoting relatively higher adhesion between the microsphere 18 and the release agent 20. This will result in microsphere 18 and release agent 20 being able to rotate relative to polymeric matrix 16. This relative rotation will allow microspheres 18 to have a rolling action with respect to the material to be formed as will be discussed. In accomplishing this rotating action, the release agent 20 can be produced from waxes or soaps, Preferably, release agent 20 is a low molecular weight polyethylene wax. However, the release agent 20 may also be a soluble wax or stearic acid.

The microspheres 18 are preferably spherical in shape. This shape aids in providing even stress distribution on the polymer matrix 16 from the microspheres 18 and to promote rotation of microspheres 18 and release agent 20 within polymeric matrix 16. Microspheres 18 should be made of a hard material to provide the hardness quality needed to reduce wear in stamping dies 10. Thus, microspheres 18 are preferably glass spheres, but they may also be made of ceramic, steel, or a metallic material. These glass spheres may be hollow or solid. The size of the microspheres preferably ranges between 0.005 inch to 0.075 inches.

Polymeric matrix 16 should have a concentration of microspheres 18 sufficient to provide a rolling action within polymeric matrix 16 (to be discussed). The concentration of microspheres 18 within polymeric matrix 16 is preferably 50% by weight. However, the concentration of microspheres 18 can range between 20% and 70% by weight. If less than a 20% concentration is used, there are not enough microspheres 18 penetrating the surface of upper portion 12 and lower portion 14. As a result, there are not enough microspheres 18 which are in contact with material 24 to achieve proper rolling action. If more than a 70% concentration is used, too many microspheres 18 penetrate the surface of upper portion 12 and lower portion 14. This excess may result in flaking off of extra microspheres 18 from polymer matrix 16.

Polymeric matrix 16 can be any thermosetting polymeric resin. Preferably, polymeric matrix 16 is an epoxy. However, polymeric matrix 16 may also be made from polyurethane, polyester, or an acrylic.

Referring to FIG. 1, the general operation of the present invention will now be described. In operation, a piece of material to be formed, such as sheet metal 24, is placed between upper portion 12 and lower portion 14. Upper portion 12 and lower portion 14 are moved in a direction closer to each other, thereby causing contact between lower portion 14 and sheet metal 24 and upper portion 12 and sheet metal 24. The compressive forces caused on sheet metal 24 due to the movement of upper portion 12 and lower portion 14 cause sheet metal 24 to take the shape of upper surface 28 and lower surface 30. Also, the compressive forces cause a reduction in thickness of sheet metal 24 which results in the expansion of sheet metal 24 in the direction shown by arrows 26. This expansion is aided by the free rotation of microspheres 18 which penetrate upper surface 28 and lower surface 30. Because of the expansion of sheet metal 24 in the directions as shown by arrows 26, there is relative movement between the surfaces 28 and 30 and sheet metal 24. As sheet metal 24 expands in the direction shown by arrows 26, the relative movement between sheet metal 24 and surfaces 28 and 30 cause rotation of microspheres 18 and release agent 20 in the directions as shown. This rotation reduces the amount of frictional wear on upper surface 28, lower surface 30, and microspheres 18 which are in contact with sheet metal 24.

Figure 2:
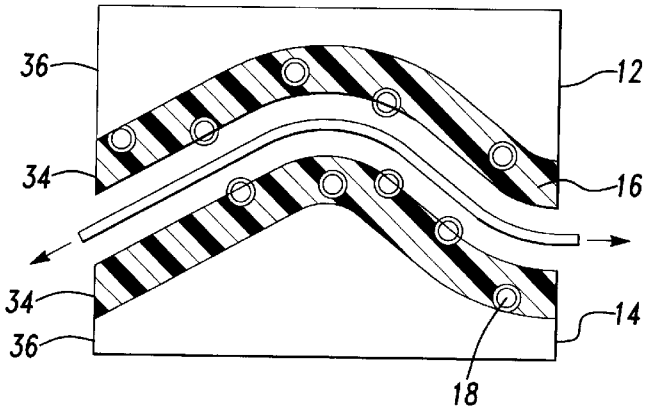
FIG. 2 is a cross-sectional view of a second embodiment of a tool for forming material according to the present invention.

With reference to FIG. 2, a second embodiment of the present invention is illustrated. Here, upper portion 12 comprises coating 34 and hard plate 36. Likewise, lower portion 14 comprises coating 34 and hard plate 36. Coating 34 can be attached to hard plate 36 by bolt, fastener, adhesion, or other suitable attachment means which is well known in the art. Coating 34 is constructed of polymeric matrix 16 with a plurality of microspheres 18 identical to that discussed above. Likewise, the operation of the upper portion 12 and lower portion 14 in the second embodiment is identical to that discussed in the first embodiment.

Figure 3:
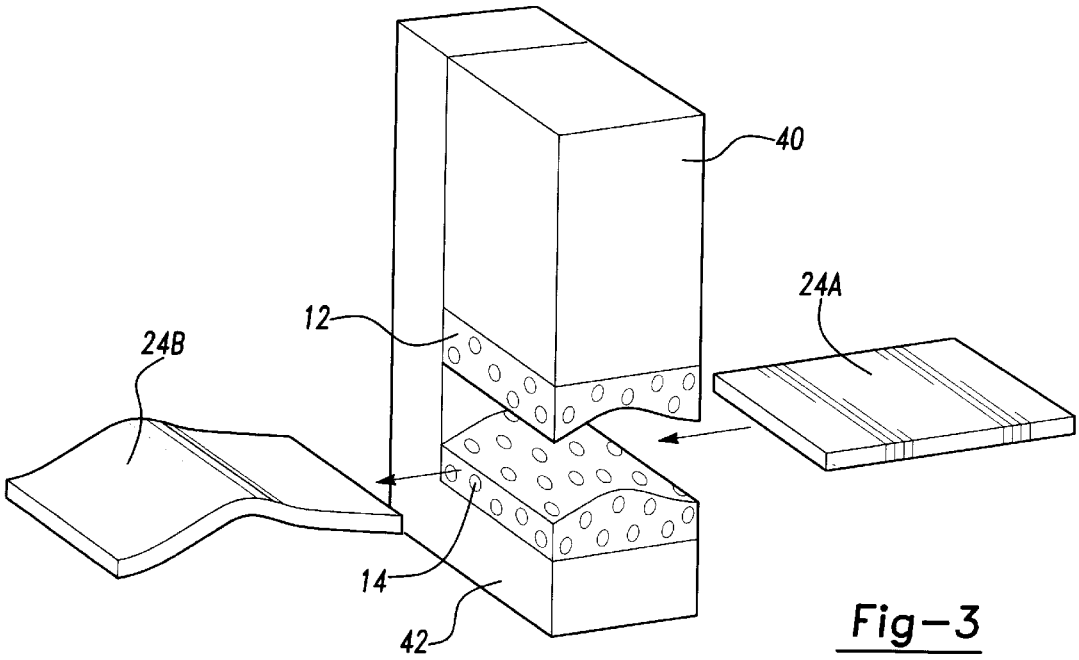
FIG. 3 is a perspective view of a tool for forming material according to the present invention.

With reference to FIG. 3, the general application of the present invention is illustrated. Here, upper portion 12 is affixed to ram 40 by bolt or other attachment means well known in the art. Likewise, lower portion 14 is attached to base portion 42. In operation, sheet metal 24A, first having a flat configuration, is moved between upper portion 12 and lower portion 14. Ram 40 is then actuated arid presses upper portion 12 down against sheet metal 24A, causing deformation thereof. After deformation of sheet metal 24A, ram 40 draws upper portion 12 away from the lower portion 14 and sheet metal 24A. The resulting form of the sheet metal is shown as 24B.

The formation of the stamping dies is now described. In the formation of the stamping dies 10, microspheres 18, being glass beads, are first coated with release agent 20. The coating process involves immersing microspheres 18 in a solution of a release agent such as stearic acid, polyethylene wax or any other suitable release agent. The beads are then removed and subsequently dried. Next, the microspheres 18, now having release agent 20 coated thereon, are mixed with a polymeric matrix 16, such as polyurethane or acrylic. The ratio of microspheres 18 mixed with polymeric matrix 16, as discussed above, is between 20% and 70%, and is preferably 50% by weight. The resulting mixture of polymeric matrix 16 and microspheres 18 is then molded into its desired shape. The resulting molded configurations are then heated to a temperature sufficient to cause curing of upper portion 12 and lower portion 14. Such curing temperatures and processes are well known in the art.

While the above detailed description described the preferred embodiment of the present invention, it should be understood that the present invention is susceptible to modification, variation, and alteration without deviating from the scope and fair meaning of the subadjoined claims.

What is claimed is:

1. A die having a contoured outer shape for forming material in a press, said die comprising:

at least one polymeric structure, said polymeric structure comprising:

a polymer matrix; and a filler material supported by said polymer matrix, said filler material being coated with a release agent.

2. The die as claimed in claim 1 wherein said filler material is a plurality of microspheres.

3. The die as claimed in claim 1 wherein said press is a stamping press, said polymeric structure being connected to said first surface of said stamping press.

4. The die as claimed in claim 3 further comprising a second polymeric structure, said second polymeric structure being detachably connected to a second surface of said stamping press, said stamping press selectively moving said polymeric structure toward said second polymeric structure for forming said material.

5. The die as claimed in claim 1 wherein said die is a stamping die and said polymeric structure is a coating on said stamping die.

6. A method for making a polymeric die, said die for forming material in a press, said method comprising:

a) coating a filler material with a release agent, mixing said filler material in a polymer matrix to form a polymeric material after said filler material has been coated with said release agent;

b) molding said polymeric material to form a desired shape; and c) curing said polymeric material.

7. The method as claimed in claim 6, wherein step c) comprises heating said polymeric material to a curing temperature.

8. The method as claimed in claim 6, wherein said filler material is a plurality of microspheres.

9. A die for forming a metal sheet in a press, said die comprising:

a body having a contoured outer surface formed to a desired shape of a formed metal sheet, said body having a polymeric matrix and a plurality of microspheres distributed therein, said miocrospheres being coated with a release agent such that said microspheres at an outer surface of said body rotate in said polymeric matrix when said metal sheet is being formed by said body.

10. The tool of claim 9 which is a stamping die which is detachably connected to said stamping press.

11. The die as claimed in claim 10, further comprising a second body, said second body being selectively movable toward said body.

12. The tool as claimed in claim 11, wherein said metal sheet is positioned between said body and said second body, said second body having a contoured outer surface complementing said contoured outer surface of said body such that said metal sheet is formed to said desired shape when said second body is moved toward said body.

13. The die as claimed in claim 10 wherein said microspheres are a member of the set consisting of solid glass spheres, ceramic spheres, steel spheres, metallic spheres and hollow glass spheres.

14. The die as claimed in claim 10 wherein each of said microspheres has a diameter greater than 0.005 inch and less than 0.075 inch.

15. The die as claimed in claim 10 wherein said release agent is a member of the set consisting of low molecular weight polyethylene wax, stearic acid and soluble wax.

16. The die as claimed in claim 10 wherein said body has a concentration of said microspheres which is greater than 20% and less than 70%.

17. The die as claimed in claim 9, farther comprising a hard plate, said body being a coating disposed on at least one side of said hard plate, said contoured outer surface being positioned opposite said hard plate.

18. The die as claimed in claim 9, wherein a portion said plurality of microspheres penetrate said polymeric matrix at said contoured outer surface, whereby said microspheres contact said metal sheet when said metal sheet is being formed by said die.

* * * * *

UNITED STATES PATENT AND TRADEMARK OFFICE

CERTIFICATE OF CORRECTION

PATENT NO. : 6,060,155

DATED : May 9, 2000

INVENTOR(S) : Bruce Norman Greve

It is certified that error appears in the above-identified patent and that said Letters Patent is hereby corrected as shown below:

ON THE TITLE PAGE, under Assignee [73], "Troy, Minn." should be --Troy, Mich.--

Column 2, line 19, "soaps," should be --soaps.--

Column 3, line 25, "arid" should be --and--

Column 4, line 38, claim 12, "tool" should be --die--

Column 4, line 56, claim 17, "farther" should be --further--

Column 4, line 60, claim 18, after "portion" insert --of--

Signed and Sealed this

Tenth Day of April, 2001

*Attest:*

Nicholas P. Godici

NICHOLAS P. GODICI

*Attesting Officer*

*Acting Director of the United States Patent and Trademark Office*